US006154116A

United States Patent [19]

Sorenson

[11] Patent Number: 6,154,116

[45] Date of Patent: Nov. 28, 2000

[54] THERMAL CIRCUIT BREAKER SWITCH

[76] Inventor: Richard W. Sorenson, 6540 SE. Harbor Cir., Stuart, Fla. 34996

[21] Appl. No.: 09/388,771

[22] Filed: Sep. 2, 1999

Related U.S. Application Data

[63] Continuation-in-part of application No. 09/328,107, Jun. 8, 1999.

[51] Int. Cl.[7] ..... H01H 37/02; H01H 37/32; H01H 37/46; H01H 37/52

[52] U.S. Cl. ..... 337/37; 337/38; 337/39; 337/59; 337/85; 337/112; 337/113; 337/334

[58] Field of Search ..... 337/334, 333, 337/343, 370, 374, 376, 377, 381, 14, 16, 23, 36, 37, 32, 38, 39, 59, 85, 66, 79, 100, 102, 140, 91, 75, 74, 67–69, 53, 112, 113, 345; 200/553–557; 29/622

[56] References Cited

U.S. PATENT DOCUMENTS

| | | | |
|---|---|---|---|
| 4,337,450 | 6/1982 | Matthies | 337/66 |
| 4,345,233 | 8/1982 | Matthies | 337/75 |
| 4,363,016 | 12/1982 | Unger | 337/56 |
| 4,528,538 | 7/1985 | Andersen | 337/43 |
| 4,559,510 | 12/1985 | Franz | 335/13 |
| 4,628,295 | 12/1986 | Yasuda et al. | 337/354 |
| 4,791,397 | 12/1988 | Wells | 337/354 |
| 4,931,762 | 6/1990 | Fierro | 337/66 |
| 4,937,548 | 6/1990 | Sdunek | 337/70 |
| 5,012,495 | 4/1991 | Munroe et al. | 337/3 |
| 5,079,530 | 1/1992 | Tsuchiyama | 335/17 |
| 5,089,799 | 2/1992 | Sorenson | 337/68 |
| 5,262,748 | 11/1993 | Tsung-Mou | 337/66 |
| 5,264,817 | 11/1993 | Sorenson | 337/68 |
| 5,451,729 | 9/1995 | Onderka et al. | 200/18 |
| 5,453,725 | 9/1995 | You et al. | 337/68 |
| 5,491,460 | 2/1996 | Krasser et al. | 337/70 |
| 5,847,638 | 12/1998 | Sorenson | 337/380 |
| 5,889,457 | 3/1999 | Hsu et al. | 337/59 |

FOREIGN PATENT DOCUMENTS

| | | | |
|---|---|---|---|
| 63-269431 | 11/1988 | Japan | 335/155 R |
| 647094 | 12/1984 | Switzerland | 337/333 R |

*Primary Examiner*—Gerald Tolin
*Assistant Examiner*—Anatoly Vortman
*Attorney, Agent, or Firm*—McCormick, Paulding & Huber LLP

[57] ABSTRACT

The thermal circuit breaker and switch has fixed and movable contacts, and non-conductive contact and trip actuators. The movable contact is provided on the free end of a lever arm that normally biases the movable contact toward its open position. The contact actuator transfers movement from a rocker or operator to the movable contact arm when no overload condition exists. The trip actuator is L shaped and rotates in a socket when engaged by a thermally sensitive bi-metallic element so as to allow one end of the contact actuator to float freely, allowing the movable contact arm's bias to open the circuit. The bi-metallic element is so positioned as to engage and rotate the trip actuator only when the bi-metallic element is deformed due to an overheat condition that occurs with an overcurrent. A compression spring acts between the upstanding legs of the trip actuator and the underside of the rocker thus biasing the rocker to the 'off' position and biasing the trip actuator to the 'reset' position. The rocker employs hooks or posts to engage and position the contact actuator to the reset position after being tripped or manually switched off.

38 Claims, 10 Drawing Sheets

THERMAL CIRCUIT BREAKER SWITCH

CROSS REFERENCE TO RELATED APPLICATIONS

This is a continuation-in-part of co-pending application Ser. No. 09/328107 filed on Jun. 8, 1999. The disclosure in Ser. No. 09/328107 is incorporated herein by reference.

BACKGROUND OF THE INVENTION

Field of the Invention

The present invention relates to thermal circuit protector devices which also function as ON/OFF switches, and deals more particularly with a structure that is simpler and less expensive to manufacture. The thermal circuit protector/switch structure also prevents a continuance or a cycli ng of an overload condition in the event manual override is attempted.

Description of the Prior Art

Switches for use either as a thermal protector circuit breaker or switch are known. Snap action bi-metallic elements have been embodied in similar thermal protectors which employ a flag of insulating material to project between the switch contacts when the bi-metal element senses an overload condition. See U.S. Pat. Nos. 5,089,799 and 5,264,817 for examples of thermal protective switches of the type utilizing such a flag.

Other thermal protective devices that serve a switch function operate via a push button action, and require that the push button be manually pulled out after the device trips the circuit in order to reset the circuit protector. Butler, U.S. Pat. No. 3,311,725 illustrates a circuit breaker/switch of this general type.

Still other thermostatic switches have a snap action disc that can be reset by a push button. See U.S. Pat. Nos. 4,791,397 and 4,628,295 for examples of disc type devices.

Although much more complicated and therefore more expensive to manufacture, thermal circuit breakers are also known. See U.S. Pat. Nos. 4,931,762; 4,937,548; and 4,258,349 for examples.

Another version of a thermal circuit breaker and switch, by the same inventor herein, uses the bi-metal element as the contact arm. See U.S. Pat. No. 5,847,638.

Still another approach to providing a rocker switch style thermal circuit breaker is shown in U.S. Pat. No. 5,491,460. However, this patent, like others of its type, requires many metal components, and metal spring elements to achieve the 'trip free' operation necessary in such protective breakers. See also U.S. Pat. Nos. 5,889,457 and 5,451,729 wherein many specially formed metal components and springs are required to provide a trip free rocker switch style thermal breaker.

The general purpose of the present invention is to provide a thermal circuit breaker and switch that does not require a flag, and has both the appearance and functional capability of a conventional rocker switch, and wherein the device is also capable of "trip free" operation so that even if manually held in the 'on' or closed position, will not result in re-closing of the contacts and hence reheating of the bi-metal. The present invention avoids the stresses imposed on the bi-metal element when used as a contact arm although the bi-metal is provided in the circuit path. Individual contact and trip actuators are provided to avoid stressing the bi-metal, thus improving both accuracy and stability of operation. While slightly more complicated and expensive than the embodiment using the bi-metal as the contact arm, this invention remains less expensive to manufacture than other thermal circuit breaker designs which have the bi-metal separate from the contact.

SUMMARY OF THE INVENTION

In accordance with the present invention, a molded hollow housing of either single body or split case construction is provided with a bottom wall and defines a top opening for pivotally receiving a rocker or bat type operator. The housing interior has a sidewall defining at least one vertical track to movably receive a contact actuator. An integrally molded socket pivotally receives and supports a trip actuator. The housing bottom wall is fitted with fixed first and second terminals. The rocker includes an extension or depending post that projects inside said housing and engages the contact actuator. The rocker includes an engagement hook to positively engage a protrusion or post on a contact actuator. The rocker incorporates a molded section having surfaces to limit movement of both the contact actuator and the rocker at least when the rocker is in the 'off' position. A single compression spring biases both the rocker toward the 'off' position and the trip actuator toward the normal or reset position.

One end of a movable conductive contact arm is fixedly mounted on a conductive mounting plate and electrically connected to the first terminal. The opposite free end of the contact arm carries a movable contact element and is biased upwardly toward the contact actuator to normally urge said movable contact element away from a fixed contact element mounted to the second terminal.

The contact actuator includes lateral projections that are slideable in said housing vertical track, such that movement of the rocker also moves the movable contact arm at least when said device is operated as a switch and there is no overload condition.

The trip actuator is 'L' shaped and has upstanding and horizontal legs that are fixedly joined at adjacent ends. The 'L' shaped trip actuator is pivotally supported at this juncture in a socket defined for it in the housing. The trip actuator has an additional surface that abuts the socket when the trip actuator is in the reset or 'off' position, thereby limiting rotation in that direction. The horizontal leg has projecting pins received in vertical channels in the housing and the upstanding leg engages said contact actuator via interfacing surfaces on both the contact actuator and the trip actuator. In response to an overcurrent a bi-metallic element moves into engagement with the horizontal leg of the trip actuator, pivoting the trip actuator and thereby disengaging the upstanding leg of the trip actuator from the contact actuator. This allows the movable contact arm's inherent bias to open the contacts as a result of the overcurrent/overheat condition in the bi-metallic element.

The bi-metallic element is 'U' shaped having two arms. The end of one arm is fixedly connected to the first terminal, and the end of the opposing arm is fixedly connected to the contact arm, preferably through a conductive jumper. The bi-metallic element electrically connects the first terminal to the movable contact arm and its movable contact. The bi-metallic element exhibits a thermally responsive change in shape or curvature such that the unrestrained free end base of the 'U' will bend upwardly toward the horizontal leg of the trip actuator in response to a predetermined current generating a temperature rise of the bi-metallic element.

Biasing means in the form of a single compression spring is provided between the underside of the rocker and the upper end of the trip actuator's upstanding leg. Thus, a single spring biases both the rocker to its 'off' position and the trip actuator to its normal position engaging the contact actuator in the absence of an overload condition. Even if the rocker is held in the 'on' position, the rocker's lower extension cannot cause the contact actuator to move the movable contact arm into a contact closed condition since one end of the contact actuator is not constrained by engagement with the trip actuator. When the rocker is not held to the 'on' position during this overload condition, the spring bias forces said rocker toward the 'off' position. Once the bi-metal element has cooled sufficiently so that it no longer abuts the trip actuator, the spring returns the trip actuator to the 'reset' position such that its upstanding leg may engage the contact actuator.

BRIEF DESCRIPTION OF THE DRAWINGS

A more complete understanding of the invention and its attendant advantages will be readily understood by reference to the following detailed description considered in conjunction with the accompanying drawings. Corresponding reference characters indicate corresponding components of the several drawings, wherein.

DETAILED DESCRIPTION

Figure 1:
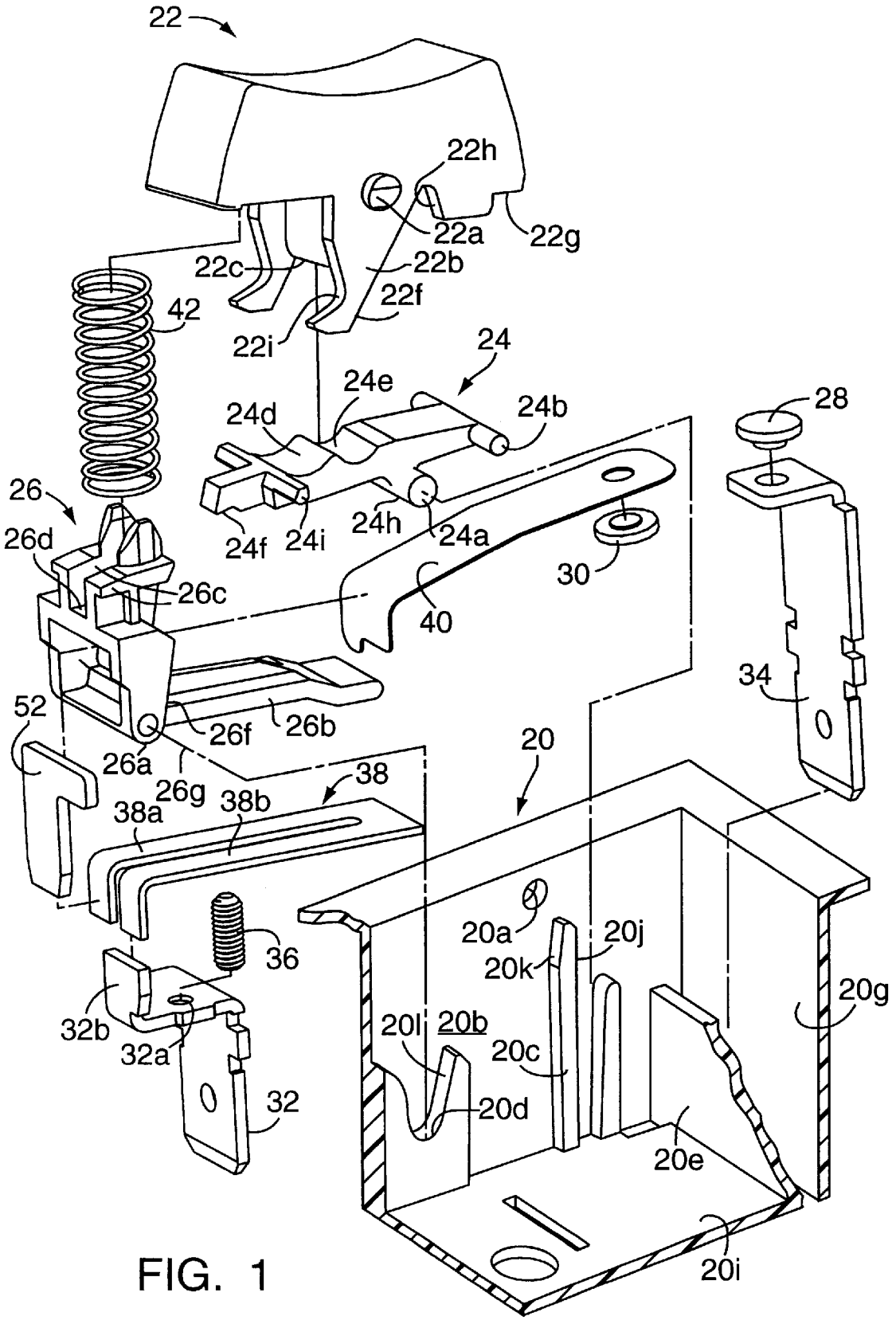
FIG. 1 is an exploded view of the embodiment of the invention.
Figure 2:
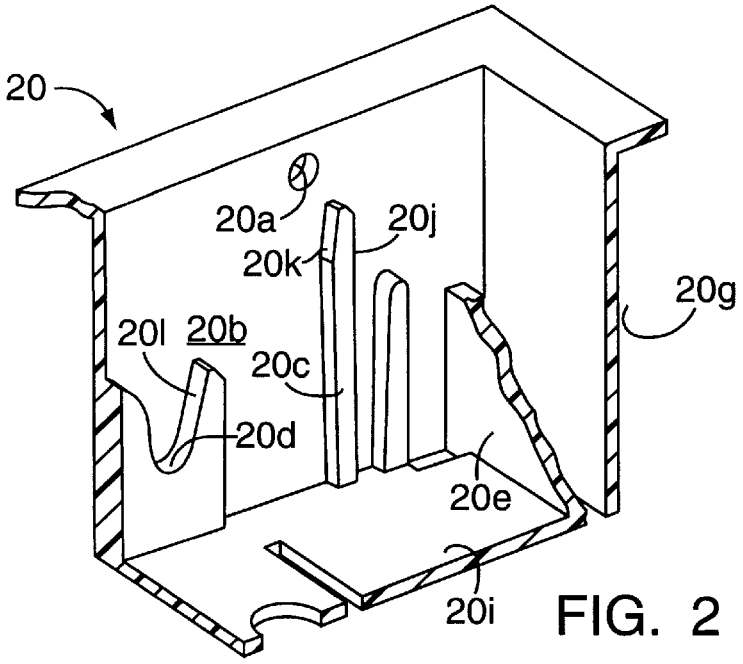
FIG. 2 is a cutaway view of the housing in isolation.
Figure 3:
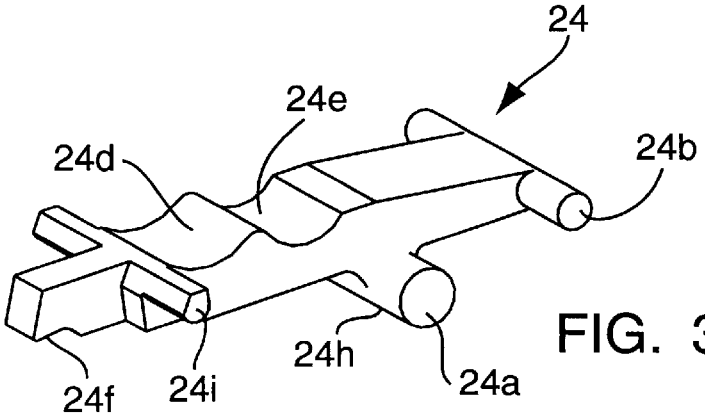
FIG. 3 is a view of the contact actuator in isolation
Figure 4:
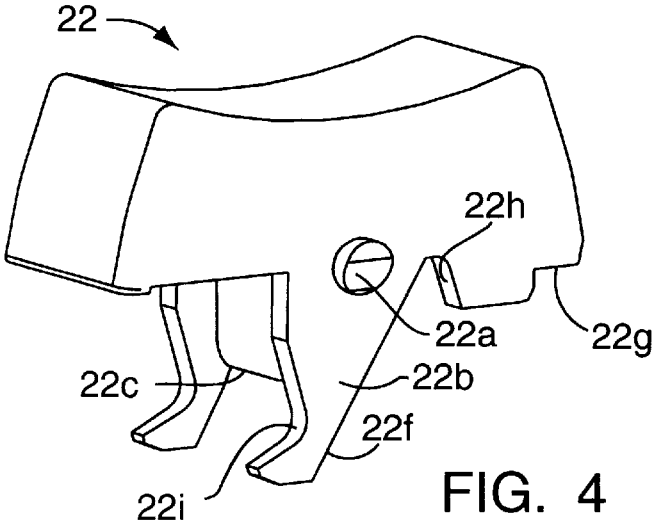
FIG. 4 is a view of the rocker in isolation.

Referring now to the drawings in greater detail, FIG. 1 shows a molded hollow housing 20 of the type having a generally rectangular upwardly open cavity for containing the following components. A pivotally mounted rocker 22 or other operator has laterally extending axle defining projections 22*a* received in axle openings 20*a* in the housing sidewalls 20*b*. The housing sidewalls 20*b* define molded vertical tracks 20*c* for slidably receiving track guide projections 24*a* on a contact actuator 24, and sockets 20*d* to receive axle defining projections 26*a* on a trip actuator 26. Thus, the L-shaped trip actuator 26 is pivotally mounted in the housing 20. The sockets 20*d* incorporate surfaces 20*l* to abut stop surfaces 26*f* and thus limit rotation of the trip actuator 26. An integrally molded barrier 20*e* in the housing insulates a terminal element 34 that has a fixed contact 28 mounted on one end of said terminal element 34.

A load and a line terminal (32 and 34, respectively) extend through slots in the housing bottom wall 20*i*. The load terminal 32 incorporates a threaded opening 32*a* which accepts an adjustment or calibration screw 36. The load terminal 32 extends upwardly along a housing end wall 20*g* and connects with a bi-metallic element 38. The element 38 is shown in FIG. 1 as being "U" shaped and having two arms 38*a* and 38*b* substantially parallel to each other. The bi-metallic element 38 is oriented in a plane roughly parallel to the housing bottom wall 20*i*, and has a thermally responsive character such that a rise in temperature, as in an overcurrent condition, causes the bi-metallic element to curve towards the trip actuator 26. The end of the calibration screw 36 contacts the lower surface of the bi-metallic element 38 to define the normal configuration for the bi-metallic element 38, and hence the extent of the deformation thereof that is required to trip the trip actuator 26.

The "U" shaped bi-metallic element has the end of one arm 38*a* connected to a fixed end of a movable contact arm 40 through a conductive jumper 52. Optionally, the one bi-metallic element arm 38*a* connects directly to the fixed end of said movable contact arm 40. An opposing arm 38*b* of the bi-metallic element is connected to a particularly adapted section of the load terminal 32 so that current flows through the bi-metallic element 38. The movable contact arm 40 is composed of a spring metal material and has a free end which is biased upward and away from a fixed contact element 28. Said free end has a movable contact element 30. The fixed contact element 28 is mounted on the line terminal 34 and so positioned that when the movable contact arm 40 is forced downward by the contact actuator 24, the movable contact element 30 closes a circuit with the fixed contact element 28.

The rocker or operator 22 is pivotally mounted in housing axle openings 20*a*, and is biased by a spring 42 to the open-circuit or 'off' position. An integrally molded extension 22*b* or depending post is provided in said rocker and is oriented roughly vertical when the rocker 22 is in the 'on' position. The rocker extension's surface 22*c* constitutes a first engagement means, which movably engages the contact actuator's upper surface 24*d* at least when the rocker is moved toward the 'on' position. Molded within the rocker extension 22*b* is an actuator hook 22*i* which acts as a second engagement means, and which removably engages an engagement post 24*i* on the contact actuator at least when the rocker is moved toward the 'off' position.

Figure 5:
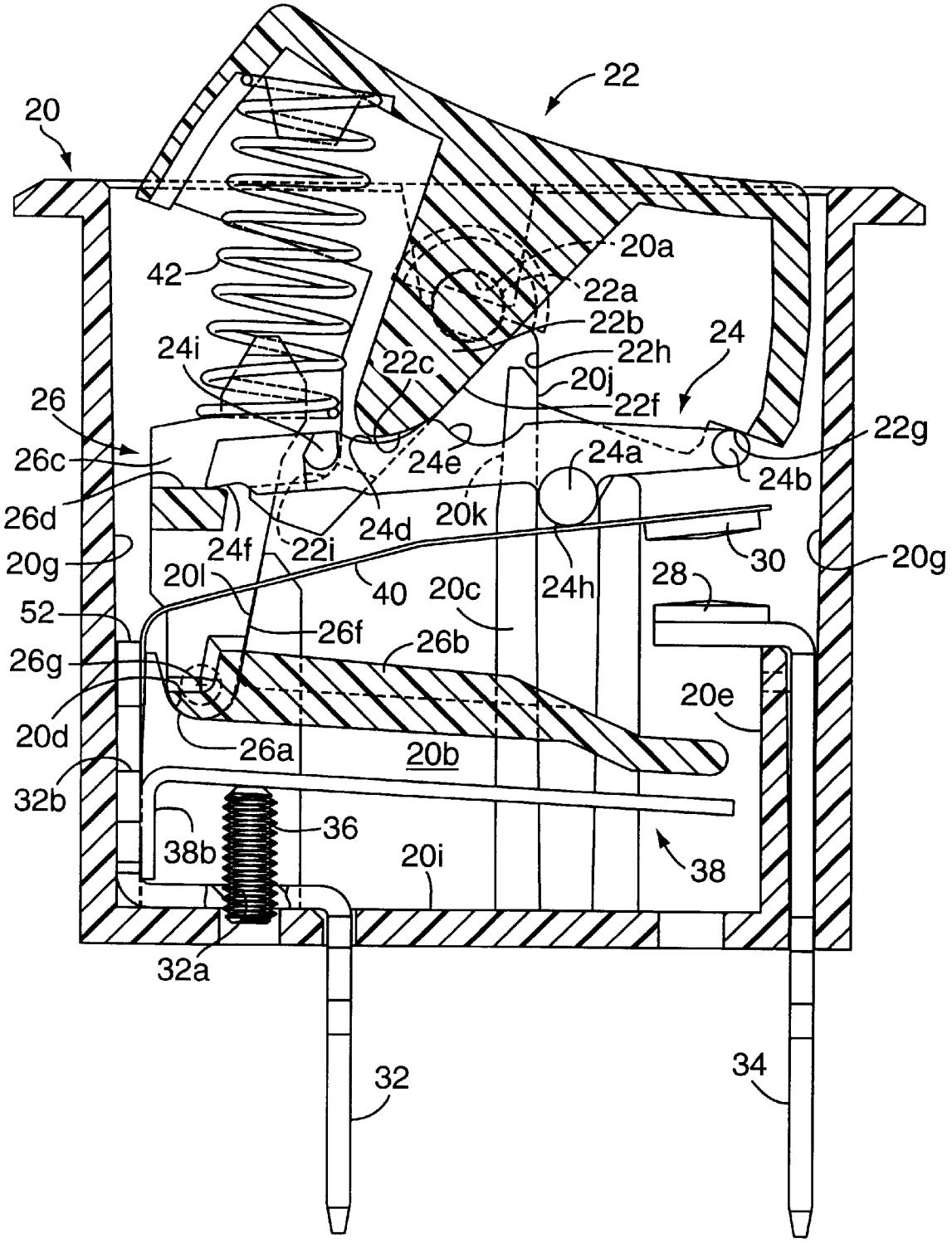
FIG. 5 is a vertical section of the invention, showing the rocker in the 'off' position, the contacts open, and no deflection of the bi-metal component.
Figure 7:
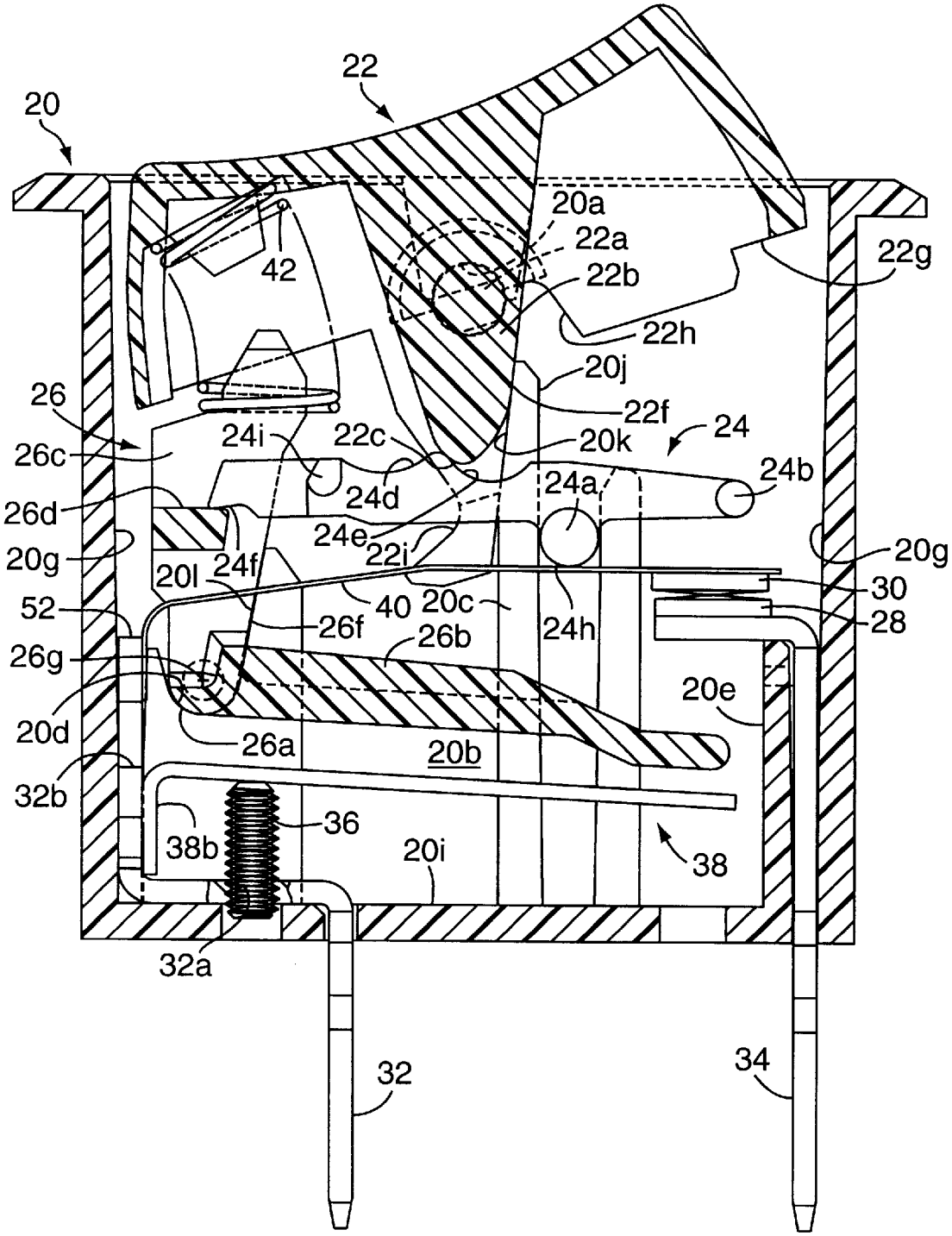
FIG. 7 is a vertical section similar to FIG. 5 and shows the rocker in the 'on' position with no overload condition.

The contact actuator 24 is provided between the upwardly biased movable contact arm 40 and the rocker 22. An actuator stop 24*b* abuts the contact stop 22*g* at the rocker's lower surface to limit upward movement of the right end (as shown in FIG. 5) at least when the rocker is in the 'off' position. This upward movement is effected by the upward biasing pressure of the contact arm 40 against surface 24*h* of the contact actuator. The rocker 22 is biased to the 'off' position by the spring 42 and is stopped in the appropriate 'off' position by the abutment of the rocker position stop 22*h* with the housing vertical track interior sidewall 20*j*. In the 'on' position, the detent 24*e* in the top surface of the contact actuator 24 latches the rocker's surface 22*c* with sufficient pressure to overcome the rocker's minimal spring bias to the 'off' position. The rocker is thereby held to the 'on' position, and is stopped there when an 'on' rocker stop 22*f* abuts a vertical track exterior sidewall 20*k*, as illustrated in FIG. 7. The contact actuator 24 has a notch 24*f* at the left end (as shown), which selectively engages a trip actuator slotted trip stop 26*d* for a purpose to be described.

The trip actuator 26 is of an "L" shape with horizontal and vertical legs (26*b* and 26*c*, respectively), and wherein the horizontal leg 26*b* is positioned between the movable contact arm 40 and the bi-metallic element 38. Axle defining projections 26*a* on the trip actuator pivotally support it in the molded socket 20*d* defined by the housing. An extension of said axle defining projections defines a stop surface 26*f*. The sockets 20*d* incorporate surfaces 20*l* that abut the trip actuator's stop surface 26*f* when in the reset position, shown in FIG. 5, thereby limiting rotation of the trip actuator in that direction. The trip actuator's upstanding leg 26*c* rise above a surface 26*d* which normally engages the notch 24*f* of the contact actuator to prevent downward movement of the notched end of the contact actuator. The rocker lower surface 22*c*, acts upon the surface 24*d* of the contact actuator at least when the rocker 22 is moved toward the 'on' position so that the contact actuator 24 will pivot approximately where it abuts the surface 26*d* of the trip actuator. This pivot action moves the right end (as shown) of the contact actuator 24 downward and surface 24*h* drives down the movable contact arm 40 to close the contact elements (28 and 30).

When the trip actuator 26*d* has pivoted or 'tripped' due to the upward movement of an over-heated bi-metal 38, the surface 26*d* of the trip actuator 26 moves out from under the notch 24*f* of the contact actuator. This defeats the pivot at the notched end described above so that the contact actuator 24 will not drive down the movable contact arm 40, regardless of movement of the rocker 22. A compression spring 42 is provided between the top of the trip actuator's upstanding leg 26*c* and the underside of the rocker 22, biasing said rocker toward the 'off' position. The spring 42 is so oriented that the spring force vector always passes slightly inboard of the trip actuator's pivot axis (shown generally at 26*g*), thereby always biasing both the rocker to the 'off' position and the trip actuator to the normal, or reset position.

FIG. 5 shows the rocker 22 in the spring biased 'off' position, the trip actuator 26*d* in the 'reset' position, and the notched end of the contact actuator 24 abutting the trip stop 26*d* of said actuator. The actuator hook 22*i* positively engages the engagement post 24*i* to assure proper positioning of the contact actuator 24. The upward bias of the movable contact arm 40 pushes the contact actuator 24 upwards until the contact actuator abuts the rocker at surfaces 22*g* and 22*c*.

Figure 6:
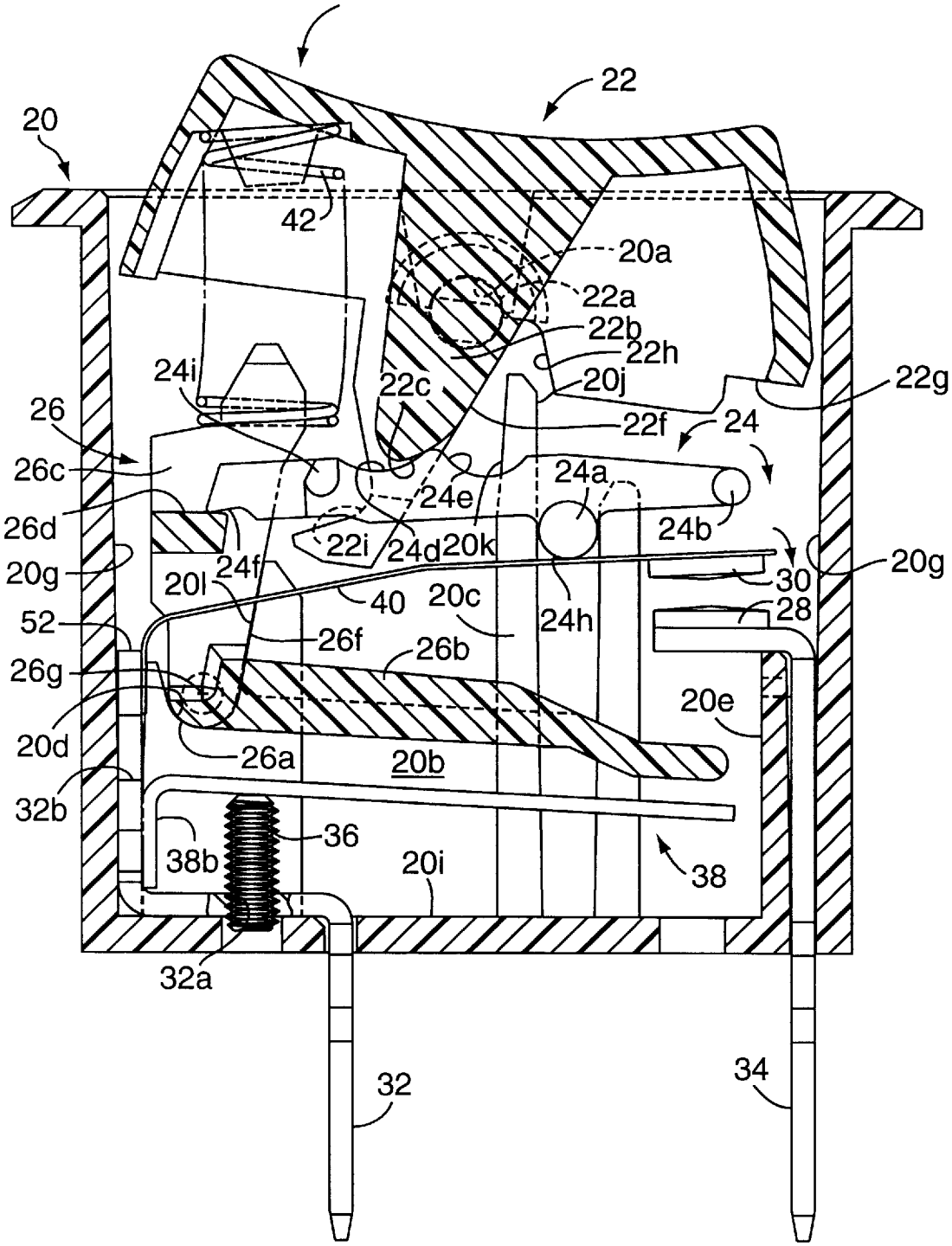
FIG. 6 is a vertical section similar to FIG. 5 and shows the rocker in transit toward the 'on' position, with arrows indicating movement of various components in transit.

FIG. 6 shows the invention with the rocker 22 in transit towards the 'on' position with pressure applied to the left portion (as shown) of said rocker. Rotation of the rocker causes the lower surface 22*c* to travel across the contact actuator surface 24*d*, depressing the contact actuator in a downward direction as it pivots at the notched end which is held in place by the trip stop 26*d*. The contact actuator 24 thereby transfers downward pressure at 24*h* to the contact arm 40 causing the contact elements 28 and 30 to close.

FIG. 7 shows the device in the closed circuit position with no overload condition. The rocker 22 is fully depressed to the 'on' position, wherein the rocker extension lower surface 22*c* rests in the 'on' position detent 24*e* of the contact actuator 24, and said contact actuator holds the movable contact arm 40 against its bias so that the contact elements (28 and 30) connect. The rocker is limited in the 'on' position by its 'on' position stop 22*f* abutting the vertical track exterior sidewall 20*k*. The bias of the compression spring 42 is insufficient to overcome the resistance of the rocker extension lower surface 22*c* in the 'on' position detent 24*e* of the contact actuator 24.

Figure 8:
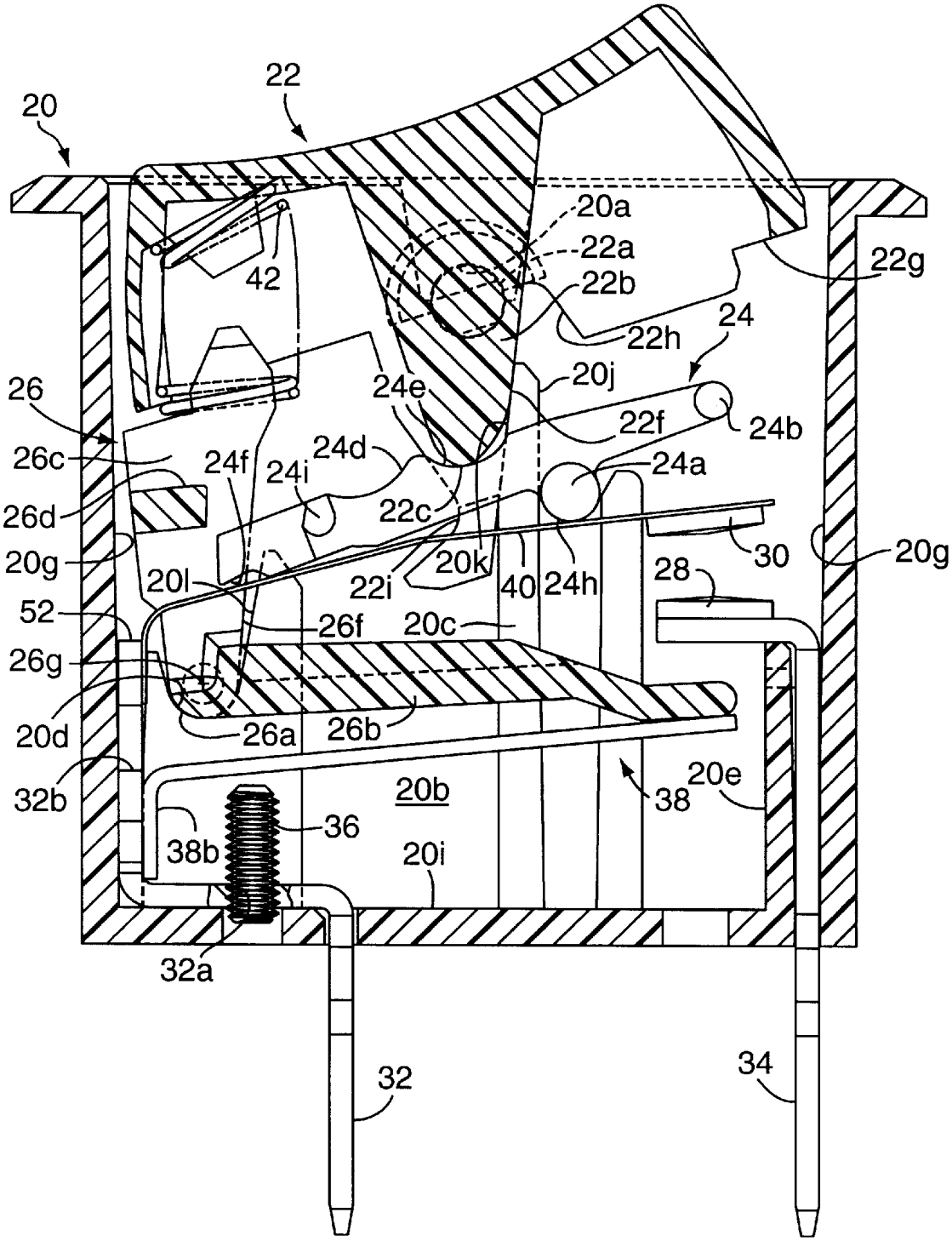
FIG. 8 is a vertical section similar to FIG. 5 and shows the 'trip free' function in operation. The bi-metallic element is deflected upwards due to an overload condition while the rocker is being manually held in the 'on' position.

FIG. 8 shows the device in the open-circuit position during an overload condition despite the rocker 22 being manually held to the 'on' position. During an overload condition, the device is subjected to an electrical load greater than its rating, causing the bi-metallic element 38 to heat up and curve upwards and engage the trip actuator's horizontal leg 26*b*. Such engagement and the bias of the element 38 itself overcomes the slight bias of the compression spring 42 and causes the trip actuator to pivot around its axle projections 26*a* that rest in the molded housing socket 20*d*. Consequently, the trip actuator's upstanding leg 26*c* rotates outboard (counter-clockwise as shown) toward the housing end wall 20*g*. Such rotation moves the trip stop 26*d* out of contact with the corresponding notch 24*f* of the contact actuator 24. The notched end then drops downward until contacting the movable contact arm 40. The contact actuator abuts the movable contact arm at the notch 24*f* and the lower surface 24*h*. The bias of the movable contact arm 40 drives the contact actuator towards the rocker until limited by contact at the lower surface 22*c* as shown, or with surface 22*g* if the shapes of the contact actuator and rocker are modified from those shown. This movement shifts the plane of the contact actuator and disengages the contact actuator's 'on' position detent 24*e* from the rocker's surface 22*c*. FIG. 8 illustrates the 'trip free' operation in that the contacts remain open during an overcurrent condition despite the rocker being forcibly held to the 'on' position.

Figure 9:
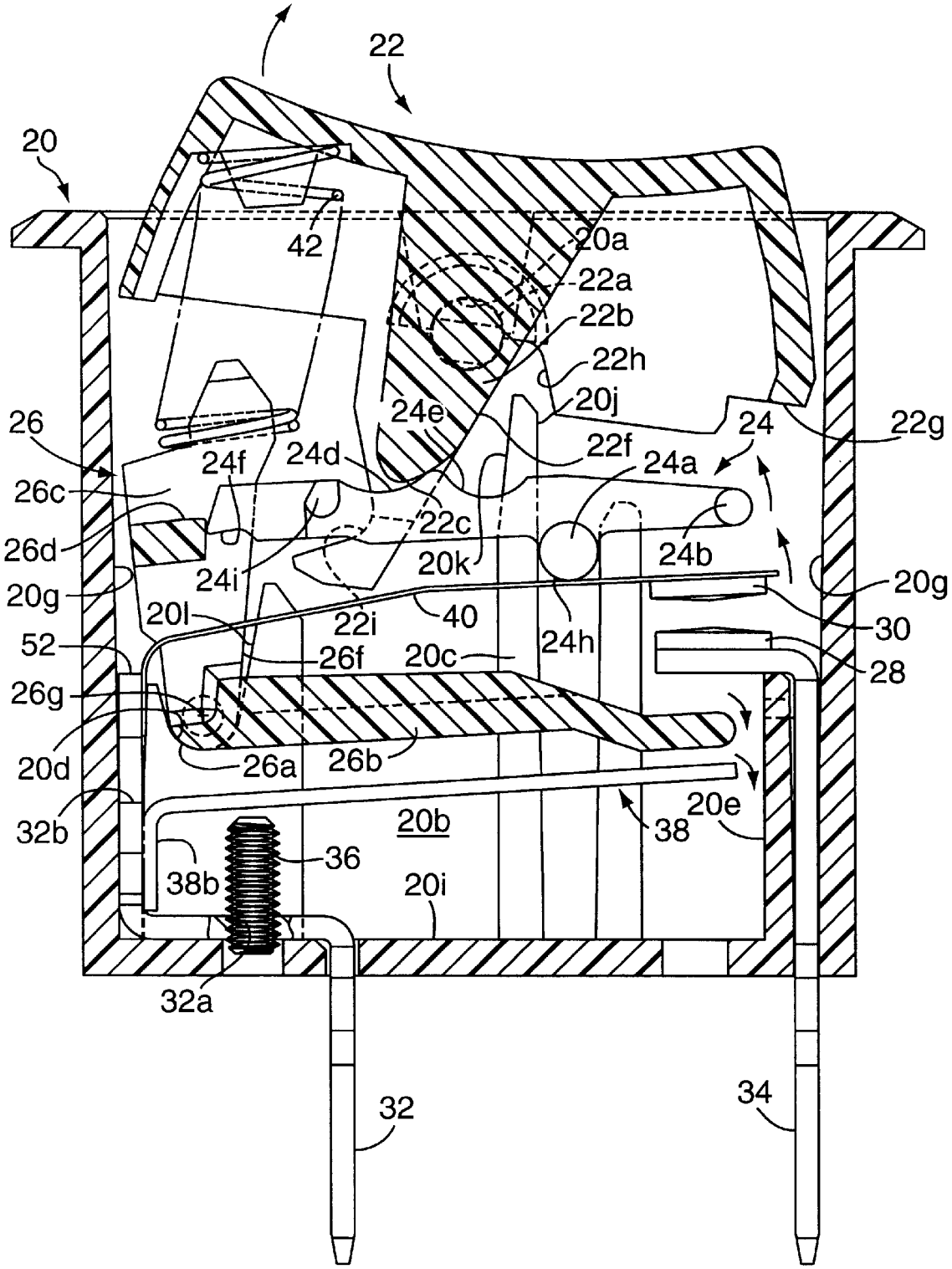
FIG. 9 is a vertical section similar to FIG. 8 and shows the rocker in transit toward the 'off' position, with arrows indicating movement of various components in transit.

FIG. 9 shows the invention with the rocker 22 in transit after an overload condition. The compression spring 42 drives the rocker to the 'off' position, and the rocker surface 22*c* slides from detent 24*e* to surface 24*d* on the contact actuator, due to the shift of the plane of the contact actuator 24 as previously described. The rocker actuator hook 22*i* engages the engagement post 24*i*, raising the notched end of the contact actuator to positively assure its proper orientation in relation to the trip actuator's trip stop 26*d*. The bi-metallic element 38 cools and returns to its undeflected shape, the trip actuator 26*d* rotates (clockwise as shown) back to its reset position due to the bias of the compression spring 42, and surface 26*d* of the trip actuator moves underneath surface 24*f* of the contact actuator, returning the invention to the position shown in FIG. 5.

Figure 10:
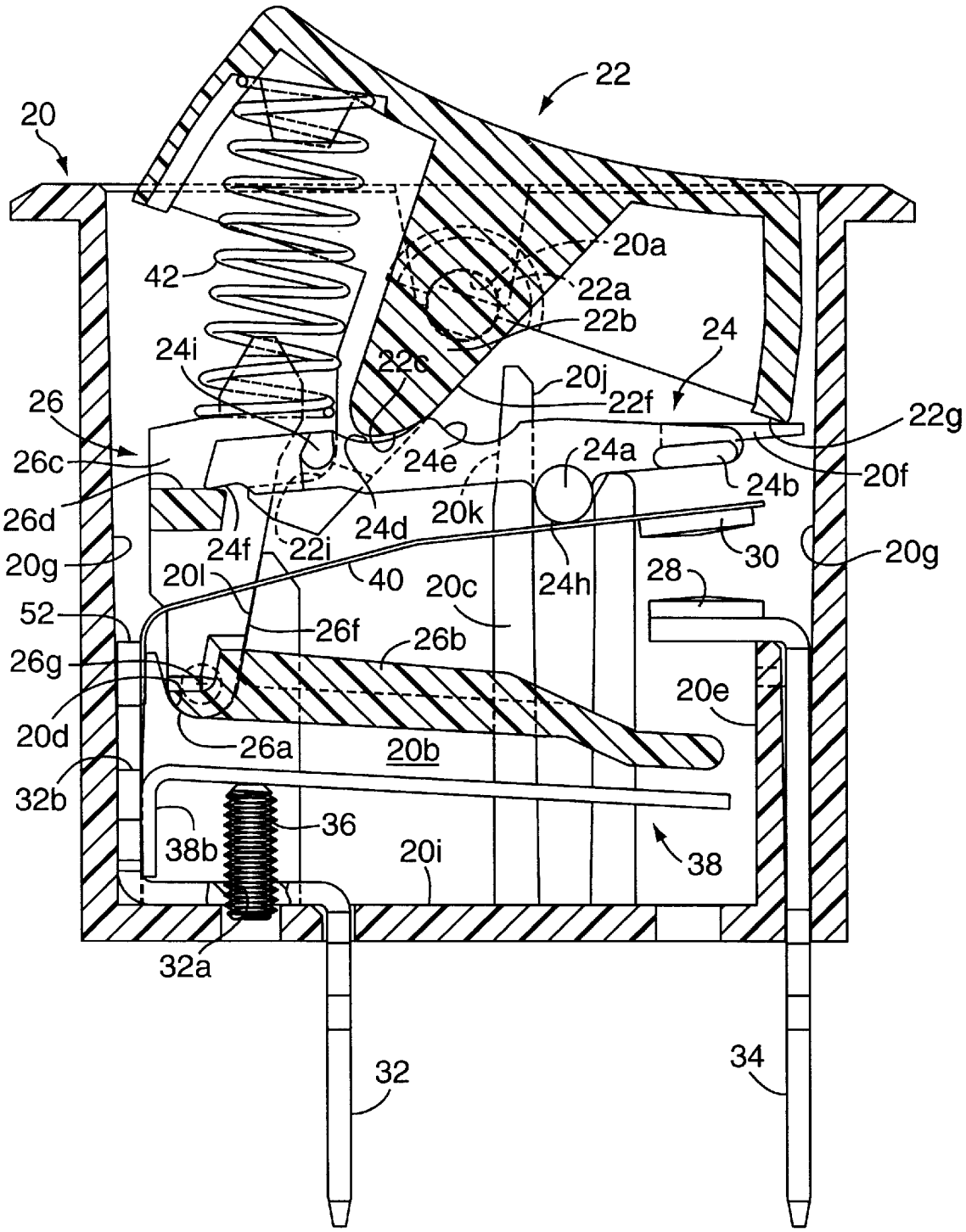
FIG. 10 is a vertical section of a first alternative embodiment of the invention.
Figure 11:
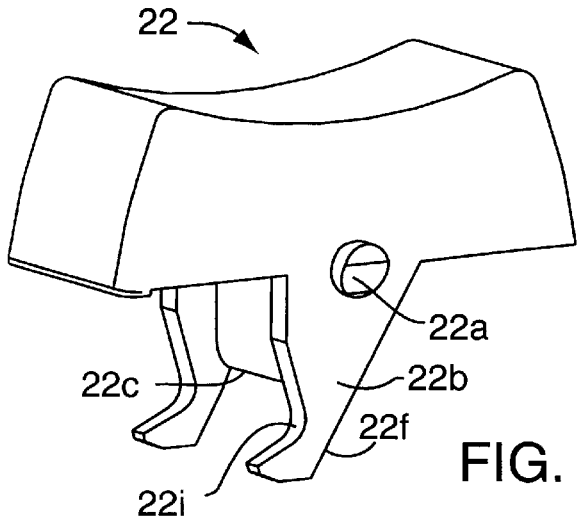
FIG. 11 is view of the rocker adapted for the first alternative embodiment shown in isolation.

An alternative embodiment is illustrated in FIG. 10, whereby the housing 20 is modified to incorporate a molded housing stop 20*f* that serves the functions of the rocker stop surfaces 22*g* and 22*h* of the first embodiment. This housing stop 20*f* serves to limit upward movement of the right end (as shown) of the contact actuator 24, and additionally to serve as an 'off' position stop for the rocker 20. The rocker modified for the first alternative embodiment is shown in isolation at FIG. 11.

Figure 13:
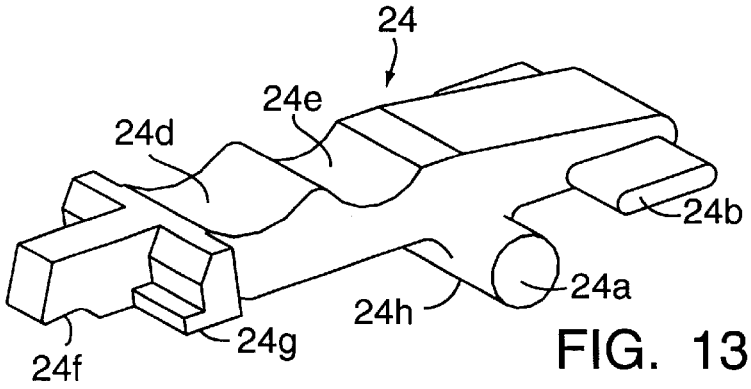
FIG. 13 is a view of the contact actuator adapted for the second alternative embodiment in isolation.
Figure 14:
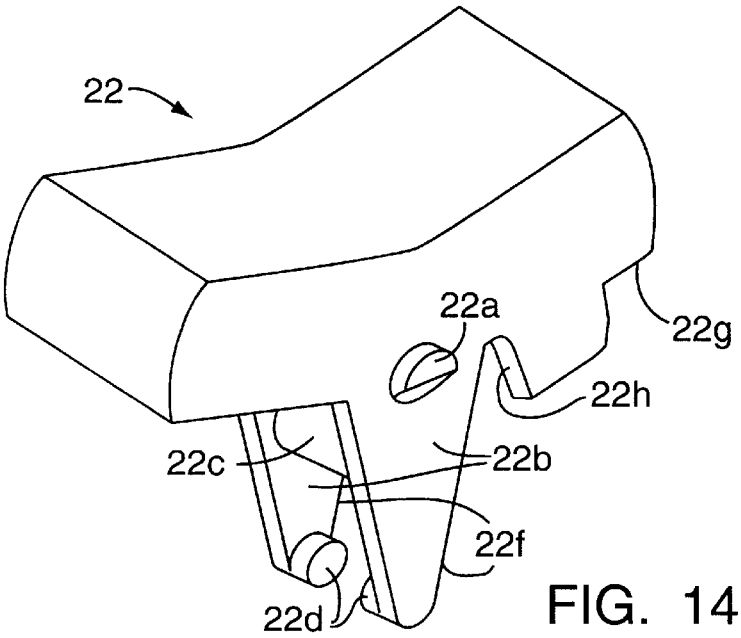
FIG. 14 is a view of the rocker adapted for the second alternative embodiment in isolation.
Figure 12:
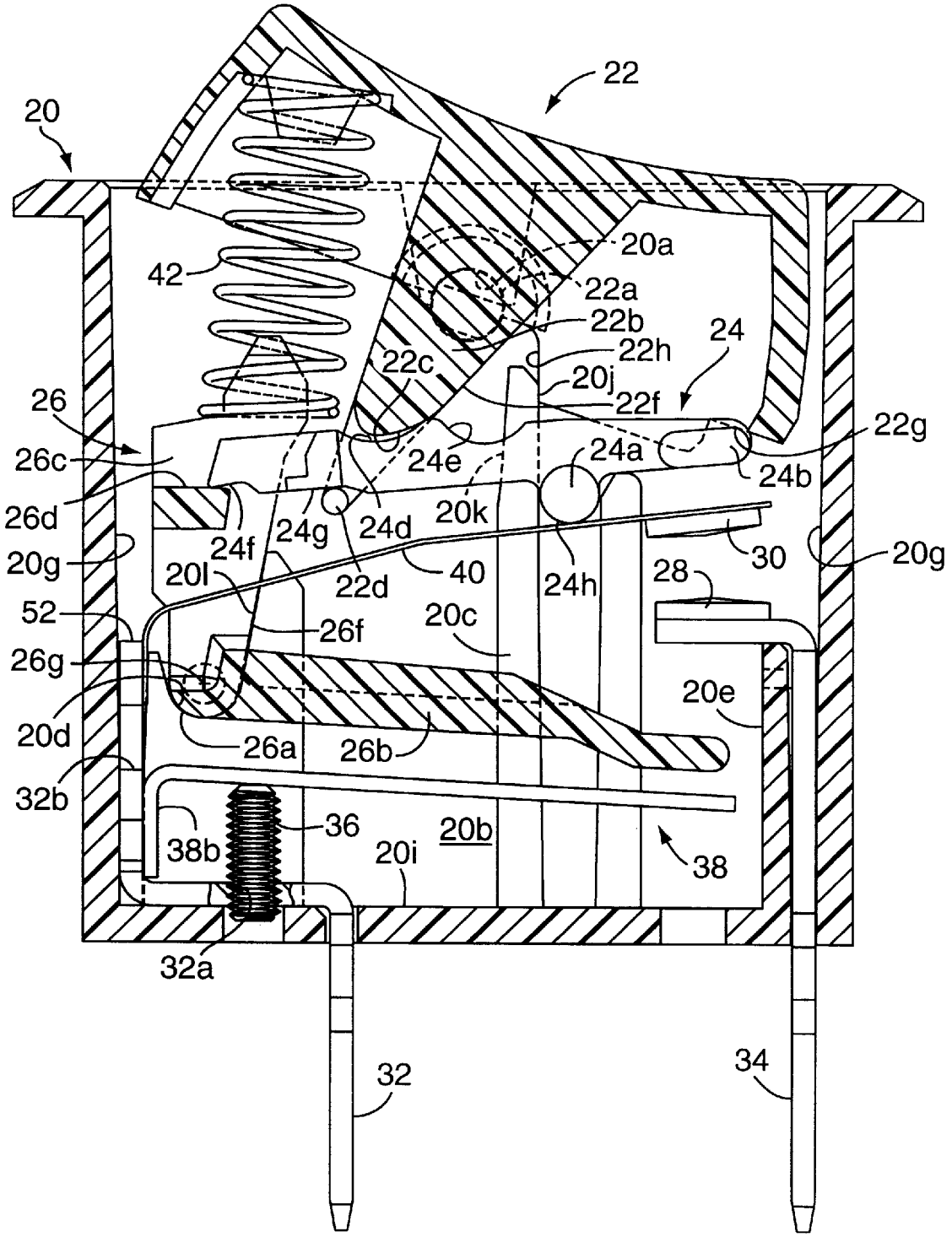
FIG. 12 is a vertical section of a second alternative embodiment of the invention.

A second alternative embodiment is shown in FIG. 12, wherein the rocker extension 22*b* incorporates inward facing projections 22*d* as the first engagement means, and which contact the lower surface of the contact actuator at least when the rocker is moved toward the 'on' position, as opposed to the actuator hook in the first embodiment. This assures positive positioning of the contact actuator notch 24*f* in relation to the trip actuator slot 26*d*. The contact actuator 24 does not include rocker engagement posts in this second alternative embodiment, but instead incorporates reset surfaces 24*g* which are particularly adapted to engage complementary surfaces on the trip actuator. FIGS. 13 and 14 show the contact actuator and rocker, respectively, modified for the second alternative embodiment.

Features of the above embodiments, and those specified in the co-pending application previously incorporated by reference, may be combined in whole or in part to obtain numerous variations for differing uses. Several such combinations of features are described below, and can be better understood with reference to the illustrations of both this and the incorporated disclosures.

Any of the above described embodiments can be modified to incorporate remote sensing means. One such modification has the bi-metal 38 completely separate from the switch circuit between terminals 32 and 34, with an independent terminal on each of its arms 38*a* and 38*b*. The bi-metal may thereby be connected to a circuit to enable the switch circuit to be opened by applying an overload current to the bi-metal from a remote source.

A second remote sensing configuration incorporates a solid state sensor to detect the reaching of a particular voltage limit in the circuit, or alternatively, the reaching of a designated pre-programmed time limit after the switch circuit has been closed. When said sensor's pre-programmed limits are reached, the sensor circuit activates a solid state switch circuit to shunt an appropriate amount of current passing through the bi-metal 38 to ground. This current being shunted through the bi-metal to ground will be adequate to cause the bi-metal to overheat, thereby resulting in the bi-metal's activating the trip actuator and opening the contacts 28 and 30 of the switch circuit. Thus the bi-metal not only provides the normal current protection feature, but simultaneously serves as the driving mechanism of the shunt circuit to effect an opening of the switch contacts when directed by the sensor. While numerous conditions can be monitored, depending upon the programming of the solid state sensor, the bi-metal's shunt-to-ground placement of the solid state switch is the significant feature. This placement preserves the bi-metal's normal function of overcurrent protection. Many alternative or combined conditions may be monitored by the sensor, such as time, ground faults, low or fluctuating voltage, etc.

Replacement of the bi-metal element 38 itself with a alternate biasing means such as a solenoid is also within the scope of this invention, wherein a solenoid has its armature arranged to exert force against the trip actuator 26, causing the circuit to open. The solenoid takes the place of the bi-metal in the modification with the solid state sensor and is employed as an alternative means to actuate the trip actuator. This substitution of a solenoid for the bi-metallic element 38 eliminates the need for the calibration screw 36*d* and its threaded opening 32*a*.

The solenoid may also be controlled by a remote trip circuit which would be connected to a neutral terminal.

Combinations of the variations above are also within the scope of this invention. For example, the bi-metallic element can be employed with a solid state switch but without a solid state sensor circuit. The solid state switch in this version may be controlled by a remote sensor circuit which would apply a signal to a terminal to activate the solid state switch, causing it to shunt a controlled current passing through the bi-metallic element to ground, or neutral, and thereby trip the mechanism, opening the mechanical switch.

Another combination example is a solenoid in place of the bi-metallic element with the solid state switch. The solid state switch would be controlled by a remote sensor circuit which would apply a signal to a terminal to activate the solid state switch causing it to apply current to the solenoid and thereby trip the mechanism, opening the mechanical switch.

Any of the above embodiments or modifications may also be incorporated into a double or multi pole thermal circuit breaker and switch whereby a single trip action by a bi-mettalic element or solenoid in any one or more of the poles causes all the embodied poles to open. Such a multi-pole function would include two or more thermal circuit breaker and switch circuits mounted side by side in one housing. Common tripping of the multi-poles would be effected by the use of either a single trip actuator serving multi-poles or by inter-connecting separate trip actuators at each pole by linking them with a connecting pin or rod.

Modifications and variations of the above described embodiment will be apparent to those skilled in the art consistent with the teaching of this disclosure, wherein examples and alternatives are illustrative rather than exhaustive. The scope of the following claims encompasses such modifications and variations in accordance with the Doctrine of Equivalents.

Component Designations

| No. | Designation | |
|---|---|---|
| 20 | housing | |
| | 20a | axle openings |
| | 20b | sidewalls |
| | 2Oc | vertical tracks |
| | 20d | sockets |
| | 20e | barrier |
| | 20f | h6using stop |
| | 20g | end walk |
| | 20h | bottom of vertical track |
| | 20i | bottom wall |
| | 20j | vertical track interior sidewall |
| | 20k | vertical track exterior sidewall |
| | 20l | socket surface |
| 22 | rocker or operator | |
| | 22a | axle defining projections |
| | 22b | extension |
| | 22c | lower surface |
| | 22d | inward facing projections |
| | 22e | 'off' rocker stop |
| | 22f | 'on' rocker stop |
| | 22g | contact stop |
| | 22h | rocker position stop |
| | 22i | actuator hook |
| 24 | contact actuator | |
| | 24a | track guide projections |
| | 24b | actuator stop |
| | 24d | engagement surface |
| | 24e | 'on' position detent |
| | 24f | notch |
| | 24g | reset surface |
| | 24h | protruding surface |
| | 24i | engagement post |
| 26 | trip actuator | |
| | 26a | axle projections |
| | 26b | horizontal leg |
| | 26c | upstanding leg |
| | 26d | trip stop |
| | 26e | projecting pin |
| | 26f | stop surface |
| 28 | fixed contact element | |
| 30 | movable contact element | |
| 32 | load terminal | |
| | 32a | threaded opening |
| | 32b | offset portion |
| 33 | neutral terminal | |
| 34 | line terminal | |
| 36 | calibration screw | |
| 38 | bi-metallic element | |
| | 38a | arm to movable contact |
| | 38b | arm to line terminal |
| 40 | movable contact arm | |
| 42 | compression spring | |
| 52 | conductive jumper | |

I claim:

1. A device having both circuit breaker and circuit switching functions, said device comprising:

a molded housing defining a hollow cavity with at least one side wall defining a track, and said housing also defining a socket spaced from said track;

a fixed contact, and a movable contact;

a contact arm having a fixed end electrically connected to said movable contact provided at its free end, and said contact arm serving to normally bias said movable contact away from said fixed contact;

a contact actuator having at least one laterally projecting portion slidably received in said track of said housing side wall;

a manually movable switch operator having an extension projecting into said cavity, said operator being movable between 'on' and 'off' positions, and having first engagement means to urge said contact actuator toward the 'on' position and having second engagement means to urge said contact actuator toward the 'off' position;

a trip actuator movably mounted in said socket and having an upstanding leg normally engaging one end of said contact actuator when said trip actuator is in its normal position to allow normal switching of said operator and contact actuator to achieve movement of said contact arm between positions wherein said contacts are closed and said contacts are open;

means responsive to a predetermined electrical condition in a circuit containing said fixed and movable contacts for shifting said trip actuator out of said normal operating position and disengaging said upstanding leg of said trip actuator from said contact actuator to prevent said switch operator from effecting said 'on' and 'off' movement of said contact arm.

2. The device according to claim 1 wherein said means responsive to a predetermined electrical condition for so shifting said trip actuator out of its normal position comprises a resilient bi-metallic element in electrical series circuit with said movable contact, said bi-metallic element having a portion that is deformed by heat in response to an overcurrent condition, said trip actuator having a second leg arranged between said contact arm and said bi-metallic element so that said deformed portion is engagable with and biases said second leg of said trip actuator for urging said trip actuator out of said normal position and thereby disengaging said upstanding leg as aforesaid.

3. The device according to claim 2 further characterized by at least two terminals that project outside said housing, wherein said bi-metallic element is of generally 'U' shape having a base portion and first and second arm portions, said bi-metallic element first arm portion electrically connected to one terminal and said second arm portion electrically connected to said movable contact, said base portion of said bi-metallic element being resiliently deformable by heat in response to an overcurrent condition.

4. The device according to claim 3 wherein the bi-metallic element further comprises additional terminals for electrically connecting said bi-metallic element to other current sources.

5. The device according to claim 3 wherein a solid state sensor and switch is connected from one end of the bi-metallic element to a neutral terminal such that the solid state sensor is able to control shunt current through the bi-metallic element to ground.

6. The device according to claim 5 wherein a solid state switch is connected from one end of the bi-metallic element to said neutral terminal and to a signal terminal such that external to the housing a sensor circuit may signal the solid state switch to shunt current through the bi-metallic element to ground.

7. The device according to claim 1 further characterized by biasing means acting between said upstanding leg of said trip actuator and said switch operator to normally return said switch operator to its 'off' position, and said biasing means also acting to urge said trip actuator into its socket.

8. The device according to claim 7 wherein said means responsive to a predetermined electrical condition for so shifting said trip actuator from its normal position comprises a solenoid having an armature element capable of extending in response to an electrical input, said trip actuator having a second leg thereof arranged between said contact arm and said solenoid element so as to be engagable by said solenoid element when so extended.

9. The device according to claim 8 wherein a solid state sensor and switch is connected from said solenoid element to a neutral terminal such that the solid state sensor is able to control shunt current through the solenoid element to ground.

10. The device according to claim 9 wherein the solid state switch further comprises additional terminal connections to electrically connect remote sensors, such that the remote sensors may electrically signal the solid state switch to apply current to the solenoid.

11. The device according to claim 1 further comprising at least one additional device alongside said device, and a common trip connection between said devices such that movement of one trip actuator effects movement of at least one additional trip actuator.

12. The device according to claim 11 wherein said common trip connection comprises a connecting rod extending through openings in adjacent housings to positively interconnect said trip actuators.

13. The device according to claim 12 wherein said rod defines the pivotal axes of the trip actuators in said adjacent side-by-side device housings.

14. The device according to claim 11 wherein said common trip connection comprises a trip actuator having portions that extend through the adjacent housings and imparts rotational movement of said trip actuator portions in said adjacent housings.

15. The device according to claim 1 wherein said second engagement means to urge said contact actuator toward the 'off' position comprises at least one hook on said switch operator and at least one protrusion on said contact actuator that is engageable by said hook.

16. The device according to claim 1 wherein said second engagement means to urge said contact actuator toward the 'off' position comprises at least one projection on said switch operator that extends below said contact actuator, said projection being engageable with the lower surface of said contact actuator.

17. The device according to claim 1 wherein said trip actuator includes a projection to abut said housing socket at least when said trip actuator is in the normal position.

18. The device according to claim 1 wherein said trip actuator includes a projecting pin receivable in said housing track, said pin abutting the bottom of said track at least when said trip actuator is in the normal position.

19. A device having both circuit breaker and circuit switching functions, said device comprising:

a molded housing defining a hollow cavity with at least one side wall defining a track, and said housing also defining a socket spaced from said track;

a fixed contact, and a movable contact;

a contact arm having a fixed end electrically connected to said movable contact provided at its free end, and said contact arm serving to normally bias said movable contact away from said fixed contact;

a contact actuator having at least one laterally projecting portion slidably received in said track of said housing side wall;

a trip actuator movably mounted in said socket and having an upstanding leg normally engaging one end of said contact actuator when said trip actuator is in its normal position to allow normal switching of said operator and contact actuator to achieve movement of said contact arm between positions wherein said contacts are closed and said contacts are open;

a manually movable switch operator having an extension projecting into said cavity, said operator being movable between 'on' and 'off' positions, said operator having a surface to abut said contact actuator at least when the switch operator is in the 'off' position and the trip actuator is in the normal position;

means responsive to a predetermined electrical condition in a circuit containing said fixed and movable contacts for shifting said trip actuator out of said normal operating position and disengaging said upstanding leg of said trip actuator from said contact actuator to prevent said switch operator from effecting said 'on' and 'off' movement of said contact arm.

20. The device according to claim 20 wherein the switch operator has a surface to abut said housing track at least when said operator is in the 'off' position.

21. The device according to claim 19 wherein said means responsive to a predetermined electrical condition for so shifting said trip actuator out of its normal position comprises a resilient bi-metallic element in electrical series circuit with said movable contact, said bi-metallic element having a portion that is deformed by heat in response to an overcurrent condition, said trip actuator having a second leg arranged between said contact arm and said bi-metallic element so that said deformed portion is engagable with and biases said second leg of said trip actuator for urging said trip actuator out of said normal position and thereby disengaging said upstanding leg as aforesaid.

22. The device according to claim 21 further characterized by at least two terminals that project outside said housing, wherein said bi-metallic element is of generally 'U' shape having a base portion and first and second arm portions, said bi-metallic element first arm portion electrically connected to one terminal and said second arm portion electrically connected to said movable contact, said base portion of said bi-metallic element being resiliently deformable by heat in response to an overcurrent condition.

23. The device according to claim 22 wherein the bi-metallic element further comprises additional terminals for electrically connecting said bi-metallic element to other current sources.

24. The device according to claim 22 wherein a solid state sensor and switch is connected from one end of the bi-metallic element to a neutral terminal such that the solid state sensor is able to control shunt current through the bi-metallic element to ground.

25. The device according to claim 24 wherein a solid state switch is connected from one end of the bi-metallic element to said neutral terminal and to a signal terminal such that external to the housing a sensor circuit may signal the solid state switch to shunt current through the bi-metallic element to ground.

26. The device according to claim 19 further characterized by biasing means acting between said upstanding leg of said trip actuator and said switch operator to normally return said switch operator to its 'off' position, and said biasing means also acting to urge said trip actuator into its socket.

27. The device according to claim 26 wherein said means responsive to a predetermined electrical condition for so shifting said trip actuator from its normal position comprises a solenoid having an armature element capable of extending in response to an electrical input, said trip actuator having a second leg thereof arranged between said contact arm and said solenoid element so as to be engagable by said solenoid element when so extended.

28. The device according to claim 27 wherein a solid state sensor and switch is connected from said solenoid element to a neutral terminal such that the solid state sensor is able to control shunt current through the solenoid element to ground.

29. The device according to claim 28 wherein the solid state switch further comprises additional terminal connections to electrically connect remote sensors, such that the remote sensors may electrically signal the solid state switch to apply current to the solenoid.

30. The device according to claim 19 further comprising at least one additional device alongside said device, and a common trip connection between said devices such that movement of one trip actuator effects movement of at least one additional trip actuator.

31. The device according to claim 30 wherein said common trip connection comprises a connecting rod extending through openings in adjacent housings to positively interconnect said trip actuators.

32. The device according to claim 31 wherein said rod defines the pivotal axes of the trip actuators in said adjacent side-by-side device housings.

33. The device according to claim 30 wherein said common trip connection comprises a trip actuator having portions that extend through the adjacent housings and imparts rotational movement of said trip actuator portions in said adjacent housings.

34. The device according to claim 19 wherein said switch operator has first engagement means to urge said contact actuator toward the position wherein said contacts are closed at least when said trip actuator is in its normal position, and has second engagement means to urge said contact actuator toward the position wherein said contacts are open.

35. The device according to claim 34 wherein said second engagement means comprises at least one hook on said switch operator and at least one protrusion on said contact actuator that is engageable by said hook.

36. The device according to claim 34 wherein said second engagement means comprises at least one projection on said switch operator that extends below said contact actuator, said projection being engageable with the lower surface of said contact actuator.

37. The device according to claim 19 wherein said trip actuator includes a projection to abut said housing socket at least when said trip actuator is in the normal position.

38. The device according to claim 19 wherein said trip actuator includes a projecting pin receivable in said housing track, said pin abutting the bottom of said track at least when said trip actuator is in the normal position.

* * * * *

UNITED STATES PATENT AND TRADEMARK OFFICE

CERTIFICATE OF CORRECTION

PATENT NO. : 6,154,116

DATED : November 28, 2000

INVENTOR(S) : Richard W. Sorenson

It is certified that error appears in the above-indentified patent and that said Letters Patent is hereby corrected as shown below:

Column 4, line 30, after "section" please insert – 32b –.

Column 7, line 49, please change "36d" to – 33 –.

Signed and Sealed this

First Day of May, 2001

*Attest:*

Nicholas P. Godici

NICHOLAS P. GODICI

*Attesting Officer*

*Acting Director of the United States Patent and Trademark Office*